US005931636A

United States Patent [19]

Savage et al.

[11] Patent Number: 5,931,636

[45] Date of Patent: Aug. 3, 1999

[54] VARIABLE AREA TURBINE NOZZLE

[75] Inventors: Joseph W. Savage, Maineville; Ely E. Halila, Cincinnati; Robert J. Orlando, West Chester; Valentine R. Boehm, Jr., Cincinnati; James A. Martus, West Chester; Thomas T. Wallace, Maineville; Monty L. Shelton, Loveland, all of Ohio

[73] Assignee: General Electric Company, Cincinnati, Ohio

[21] Appl. No.: 08/919,520

[22] Filed: Aug. 28, 1997

[51] Int. Cl.[6] ..... F01D 17/16

[52] U.S. Cl. ..... 415/115; 415/160; 415/161; 415/230

[58] Field of Search ..... 415/115, 159, 415/160, 161, 162, 170.1, 230, 231

[56] References Cited

U.S. PATENT DOCUMENTS

| | | | |
|---|---|---|---|
| 94,162 | 8/1869 | Wolf et al. | 415/161 |
| 2,873,683 | 2/1959 | Sherwood | 415/230 |
| 4,193,738 | 3/1980 | Landis, Jr. et al. | 415/115 |
| 4,214,852 | 7/1980 | Tuley et al. | 415/115 |
| 4,695,220 | 9/1987 | Dawson | 415/160 |
| 4,705,452 | 11/1987 | Karadimas | 415/115 |
| 4,741,665 | 5/1988 | Hanser | 415/161 |
| 4,897,020 | 1/1990 | Tonks | 415/115 |
| 5,314,301 | 5/1994 | Knight | 415/161 |
| 5,324,165 | 6/1994 | Charbonnel et al. | 415/160 |
| 5,332,357 | 7/1994 | Tubbs | 415/160 |
| 5,520,511 | 5/1996 | Loudet et al. | 415/161 |

FOREIGN PATENT DOCUMENTS

| | | | |
|---|---|---|---|
| 850681 | 9/1952 | Germany | 415/160 |
| 1003512 | 2/1957 | Germany | 415/160 |
| 356730 | 10/1961 | Switzerland | 415/160 |
| 2266562 | 3/1993 | United Kingdom . | |

*Primary Examiner*—Christopher Verdier
*Attorney, Agent, or Firm*—Andrew C. Hess; David L. Narciso

[57] ABSTRACT

A variable area turbine nozzle includes a plurality of circumferentially adjoining nozzle segments. Each nozzle segment includes outer and inner bands, with a plurality of first vane segments fixedly joined therebetween. A plurality of second vane segments adjoin respective ones of the first vane segments to define therewith corresponding vanes which are spaced apart to define respective throats of minimum flow area for channeling therethrough combustion gas. The second vane segments are pivotable to selectively vary the throat area.

13 Claims, 4 Drawing Sheets

VARIABLE AREA TURBINE NOZZLE

BACKGROUND OF THE INVENTION

The present invention relates generally to gas turbine engines, and, more specifically, to turbine nozzles therein.

The core engine of a gas turbine engine typically includes a multistage axial compressor which provides compressed air to a combustor wherein it is mixed with fuel and ignited for generating hot combustion gas which flows downstream through a high pressure turbine nozzle and in turn through one or more stages of turbine rotor blades. The high pressure turbine blades are suitably joined to a rotor disk which is joined to the compressor by a corresponding drive shaft, with the turbine blades extracting energy for powering the compressor during operation. In a two spool engine, a second shaft joins a fan upstream of the compressor to a low pressure turbine disposed downstream from the high pressure turbine for providing additional propulsion force for typical use in powering an aircraft in flight.

Typical turbine nozzles, such as high pressure and low pressure turbine nozzles, have fixed vane configurations and fixed nozzle throat areas therebetween in view of the severe temperature and high pressure loading environment in which they operate. The throat areas between adjacent nozzle vanes must be accurately maintained for maximizing performance of the engine, yet the hot thermal environment requires that the turbine nozzle be manufactured in circumferential segments for reducing thermal stress during operation. The nozzle segments therefore require suitable inter-segment sealing to reduce undesirable flow leakage, which further complicates turbine nozzle design.

Variable cycle engines are being developed for maximizing performance and efficiency over subsonic and supersonic flight conditions. Although it would be desirable to obtain variable flow through turbine nozzles by adjusting the throat areas thereof, previous attempts thereat have proved impractical in view of the severe operating environment of the nozzles. For example, it is common to provide variability in compressor stator vanes by mounting each vane on a radial spindle and collectively rotating each row of compressor vanes using an annular unison ring attached to corresponding lever arms joined to each of the spindles. In this way the entire compressor vane rotates or pivots about a radial axis, with suitable hub and tip clearances being required for permitting the vanes to pivot.

Applying the variable compressor configuration to a turbine nozzle has substantial disadvantages both in mechanical implementation as well as in aerodynamic performance. The severe temperature environment of the turbine nozzles being bathed in hot combustion gases from the combustor typically requires suitable cooling of the individual vanes, with corresponding large differential temperature gradients through the various components. A pivotable nozzle vane increases the difficulty of design, and also provides hub and tip gaps which require suitable sealing since any leakage of the combustion gas therethrough adversely affects engine performance and efficiency which negates the effectiveness of the variability being introduced.

Furthermore, nozzle vanes are subject to substantial aerodynamic loads from the combustion gas during operation, and in view of the airfoil configuration of the vanes, a substantial load imbalance results from the center-of-rotation of the individual vanes being offset from the aerodynamic center-of-pressure. This imbalance drives the required actuation torque loads upwardly and increases bending loads throughout the nozzle vanes to unacceptable levels.

Such adjustable nozzle vanes necessarily reduce the structural integrity and durability of the nozzle segments in view of the increased degree of freedom therebetween. And, angular pivoting of the individual nozzle vanes directly corresponds with the angular pivoting of the actuating lever arm joined thereto, which renders difficult the implementation of relatively small variations in throat area required for effective variable cycle operation.

Accordingly, it is desired to have a variable area turbine nozzle having improved construction and actuation for improving durability and performance during operation, and increasing accuracy of throat area variation.

SUMMARY OF THE INVENTION

A variable area turbine nozzle includes a plurality of circumferentially adjoining nozzle segments. Each nozzle segment includes outer and inner bands, with a plurality of first vane segments fixedly joined therebetween. A plurality of second vane segments adjoin respective ones of the first vane segments to define therewith corresponding vanes which are spaced apart to define respective throats of minimum flow area for channeling therethrough combustion gas. The second vane segments are pivotable to selectively vary the throat area.

BRIEF DESCRIPTION OF THE DRAWINGS

The invention, in accordance with preferred and exemplary embodiments, together with further objects and advantages thereof, is more particularly described in the following detailed description taken in conjunction with the accompanying drawings in which.

DESCRIPTION OF THE PREFERRED EMBODIMENT(S)

Figure 1:
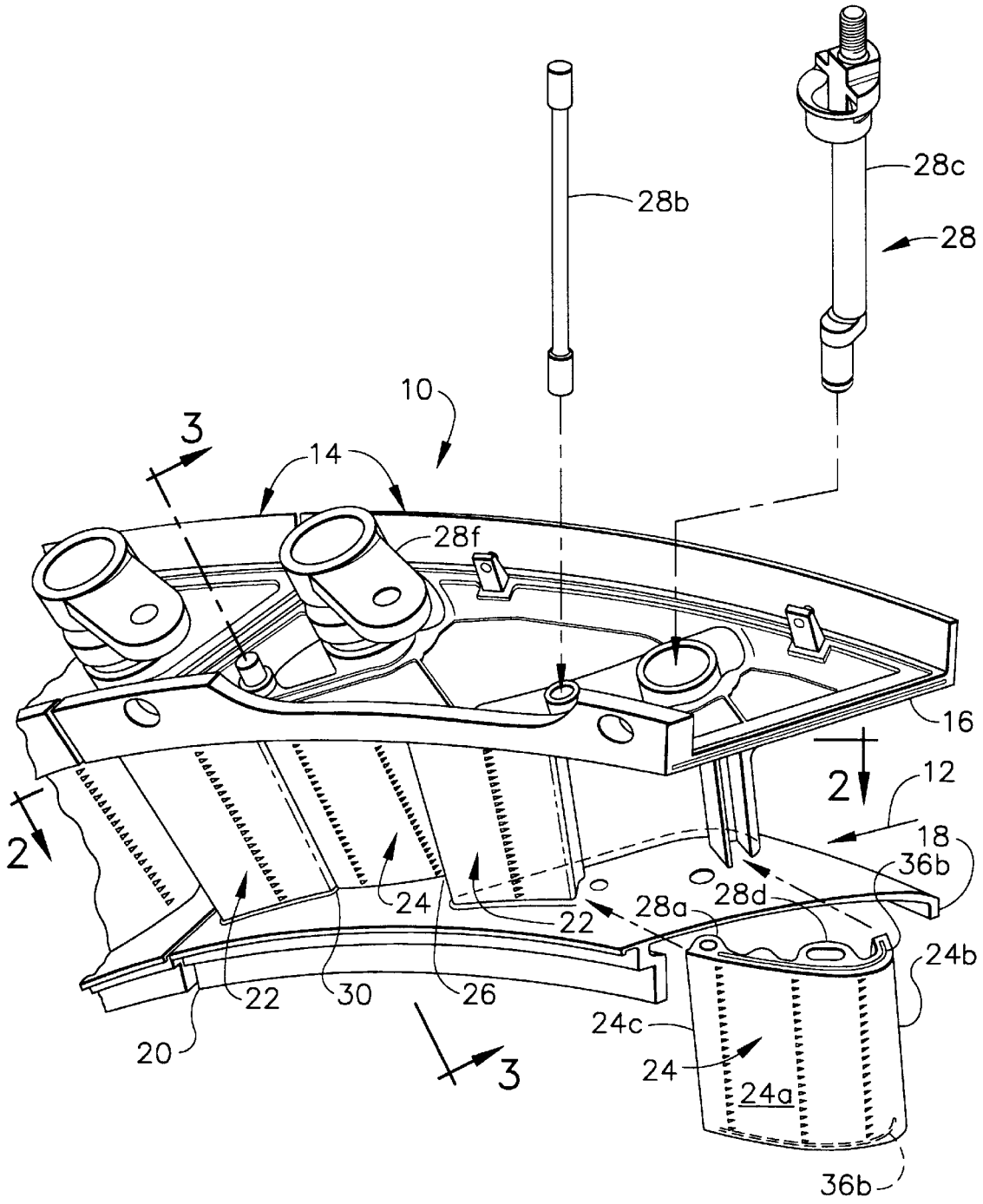
FIG. 1 is a partly exploded, isometric view of a portion of an exemplary gas turbine engine turbine nozzle having variable area nozzle segments in accordance with an exemplary embodiment of the present invention.

Illustrated in FIG. 1 is a portion of an annular variable area turbine nozzle 10 configured as a high pressure turbine nozzle for firstly receiving high temperature combustion gas 12 from an annular combustor in a gas turbine engine (not shown). The gas turbine engine may be configured for powering an aircraft in flight over subsonic and supersonic flight speeds and includes a first spool or rotor having a compressor and cooperating high pressure turbine, and a second rotor or spool including a fan and low pressure turbine cooperating therewith (not shown).

The nozzle 10 is configured for providing variable area to selectively control the flow of the combustion gas 12 from the combustor to the rotor blades of the high pressure turbine. The variable area nozzle 10 is also referred to as a Controlled Area Turbine Nozzle (CATN).

In view of the severe temperature environment of the turbine nozzle 10 and the substantial aerodynamic and thermal loads accommodated thereby, the nozzle 10 is configured in a plurality of circumferentially adjoining nozzle segments 14 which collectively form a full, annular ring about the centerline axis of the engine.

Each nozzle segment 14 includes arcuate outer and inner bands 16, 18 radially spaced apart from each other. Circumferentially adjacent bands define splitlines 20 which thermally uncouple the adjacent nozzle segments 14 from each other, and require conventional sealing therebetween using spline seals for example.

Each nozzle segment 14 preferably includes a plurality of circumferentially spaced apart first or stationary vane segments 22 extending radially, or longitudinally, between the outer and inner bands 16, 18, which are fixedly or integrally joined thereto in a one-piece box structure which may be formed conventionally as a single casting. In the exemplary embodiment illustrated in FIG. 1, two first vane segments 22 are joined to the common outer and inner bands, and provide a rigid structural assembly for accommodating thermal and aerodynamic loads during operation while providing a stationary reference for accurately effecting preferred flow areas as described hereinbelow.

Figure 2:
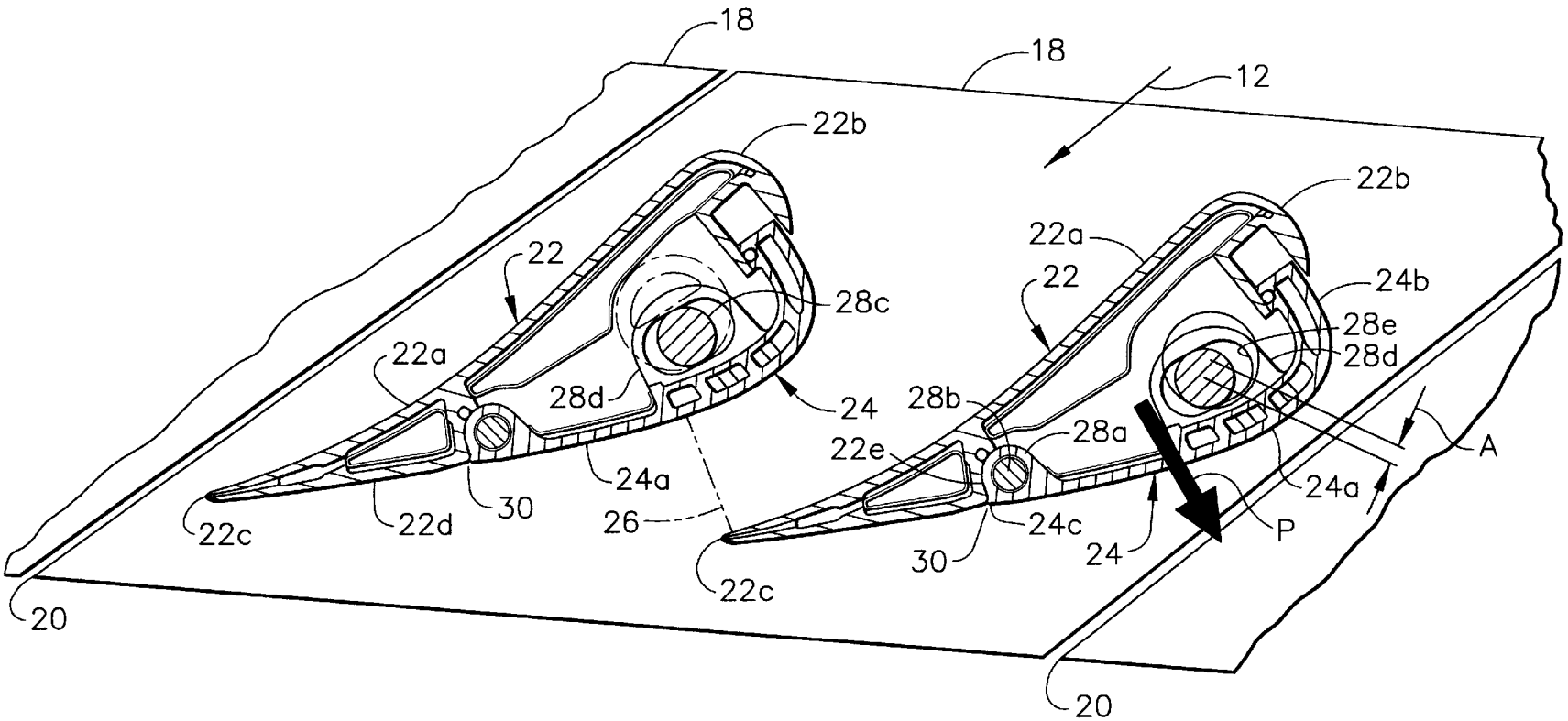
FIG. 2 is a top, sectional view of one of the exemplary nozzle segments illustrated in FIG. 1 and taken generally along line 2—2 for showing two adjoining nozzle vanes for effecting variable area throats therebetween.

A plurality of pivotable or second vane segments 24 circumferentially adjoin respective ones of the first vane segments 22 to define therewith corresponding two-segment vanes as shown in more particularity in FIG. 2. In this exemplary embodiment, each of the first vane segments 22 is conventionally aerodynamically configured to define a concave or pressure sidewall 22*a* extending between a leading edge 22*b* and a trailing edge 22*c*.

Correspondingly, each of the second vane segments 24 is aerodynamically configured to define a portion of a convex or suction sidewall 24*a* extending between a first or forward end 24*b* and a second or aft end 24*c* spaced apart along the chord axis of the vanes. In the exemplary embodiment illustrated in FIG. 2, the second end 24*c* extends only part-chord between the leading and trailing edges 22*b, c,* with the sidewall 24*a* of the second vane segment 24 defining only a portion of the vane suction side. The remaining portion of the vane suction side is defined by a corresponding suction sidewall 22*d* of the first vane segment 22 extending from the trailing edge 22*c*.

In this way, the two first vane segments 22 between the leading and trailing edges 22*b, c* are fixedly joined in their entireties to both the outer and inner bands 16, 18 to create a four-piece rigid box structure to which the second vane segments 24 are suitably pivotally attached. This box structure provides structural rigidity for each nozzle segment 14 without any undesirable splitlines therein. The splitlines 20 are provided solely between the adjacent nozzle segments 14 in an otherwise conventional manner for accommodating differential thermal growth during operation.

The mounting arrangement of the first vane segments 22 also provides an inherent seal along the entire pressure sidewall 22*a* between the leading and trailing edges 22*b, c* to prevent undesirable crossflow of the combustion gas 12 past the individual vanes.

As shown in FIG. 2, the vanes are circumferentially spaced apart from each other to define corresponding throats 26 of minimum flow area, typically designated A4, for channeling therethrough the combustion gas 12 which in turn is received by the turbine rotor blades which extract energy therefrom in a conventional manner. Each throat 26 is defined by the minimum distance between the trailing edge 22*c* of one vane and a corresponding location on the suction sidewall 24*a* of the adjacent vane.

Figure 3:
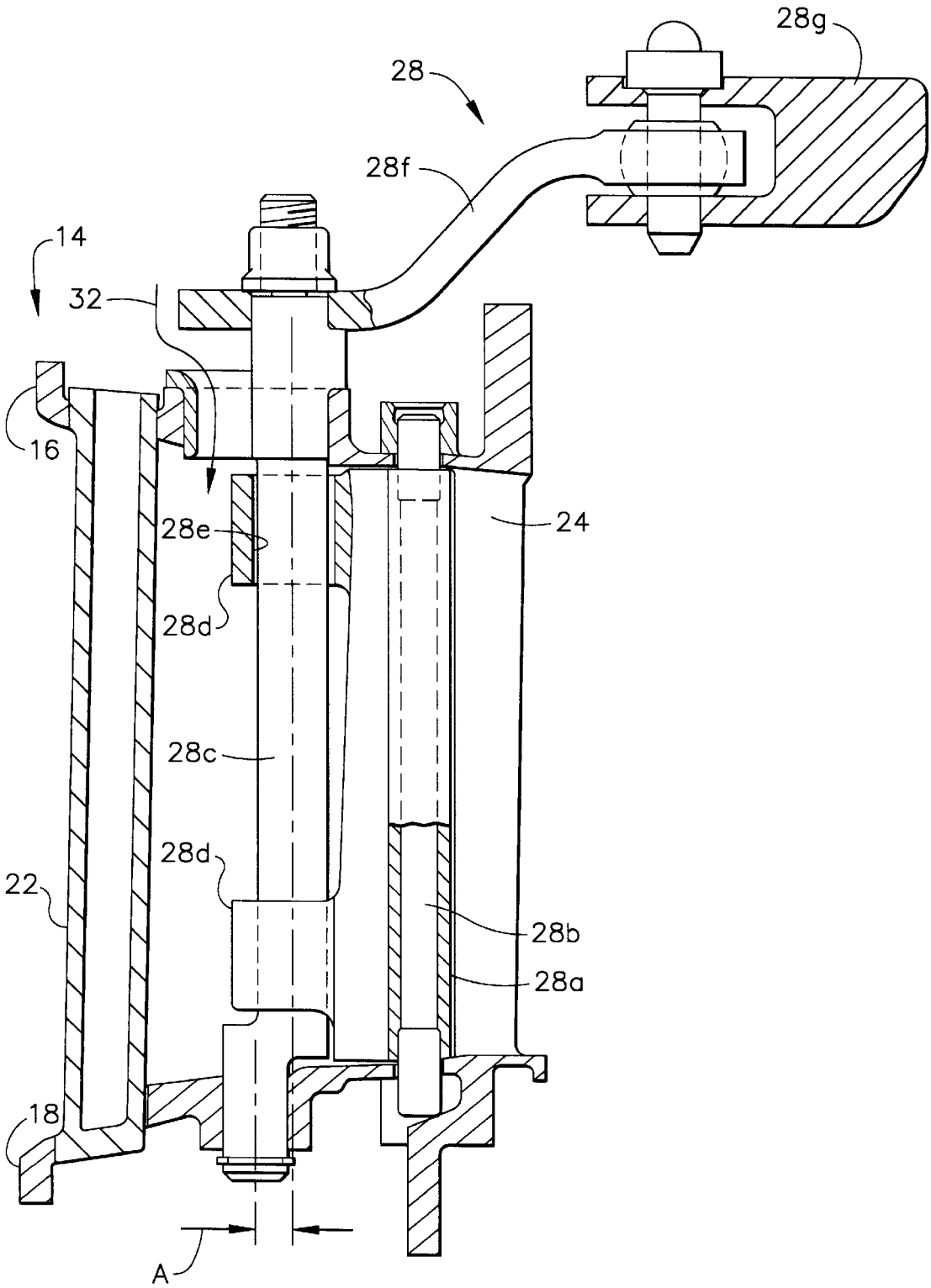
FIG. 3 is a partly sectional, elevational view through one of the variable area nozzle vanes illustrated in FIG. 1 and taken generally along line 3—3.

In accordance with the present invention as illustrated in FIG. 3, means 28 are provided for pivoting each of the second vane segments 24 relative to its cooperating first vane segment 22 to selectively vary the individual throat areas 26 between the several vanes. Since the first vane segments 22 and the bands 16, 18 provide a rigid structure, the second vane segments 24 may be relatively simply mounted thereto for pivoting movement to provide controlled variable area capability. However, the individual second vane segments 24 must also be mounted to accommodate the substantial thermal and aerodynamic loads during operation without undesirable distortion which could adversely affect their movement, and without adversely affecting accurate control of the throat areas.

In the preferred embodiment illustrated in FIGS. 1 and 2, the pivoting means 28 preferably include a corresponding hinge tube 28*a* integrally or fixedly joined to respective ones of the second vane segments 24 on the inside thereof at the aft end 24*c*, and defines a radial or longitudinal hinge gap 30 with a complementary hinge seat 22*e* integrally formed in the first vane segment 22.

A corresponding elongate hinge pin 28*b* extends radially through corresponding apertures in the outer and inner bands 16, 18 and respective ones of the hinge tubes 28*a* to pivotally mount each of the second vane segments 24 to the respective first vane segments 22 for pivoting movement relative thereto in the manner of a swinging door.

A respective actuation cam shaft 28*c* extends radially through corresponding apertures in the outer and inner bands 16, 18, and is operatively joined to respective ones of the second vane segments 24 to pivotally adjust the second vane segments to vary the throat area 26.

The cam shaft 28*c* may take various configurations to cooperate with the inside of the corresponding second vane segments 24 for pivoting thereof. As shown in more particularity in FIG. 3, each of the second vane segments 24 preferably includes a pair of longitudinally or radially spaced apart cam lugs 28*d* integrally or fixedly joined to the inside thereof. As shown more clearly in FIG. 2, each of the lugs 28*d* includes an oval slot 28*e*.

Figure 4:
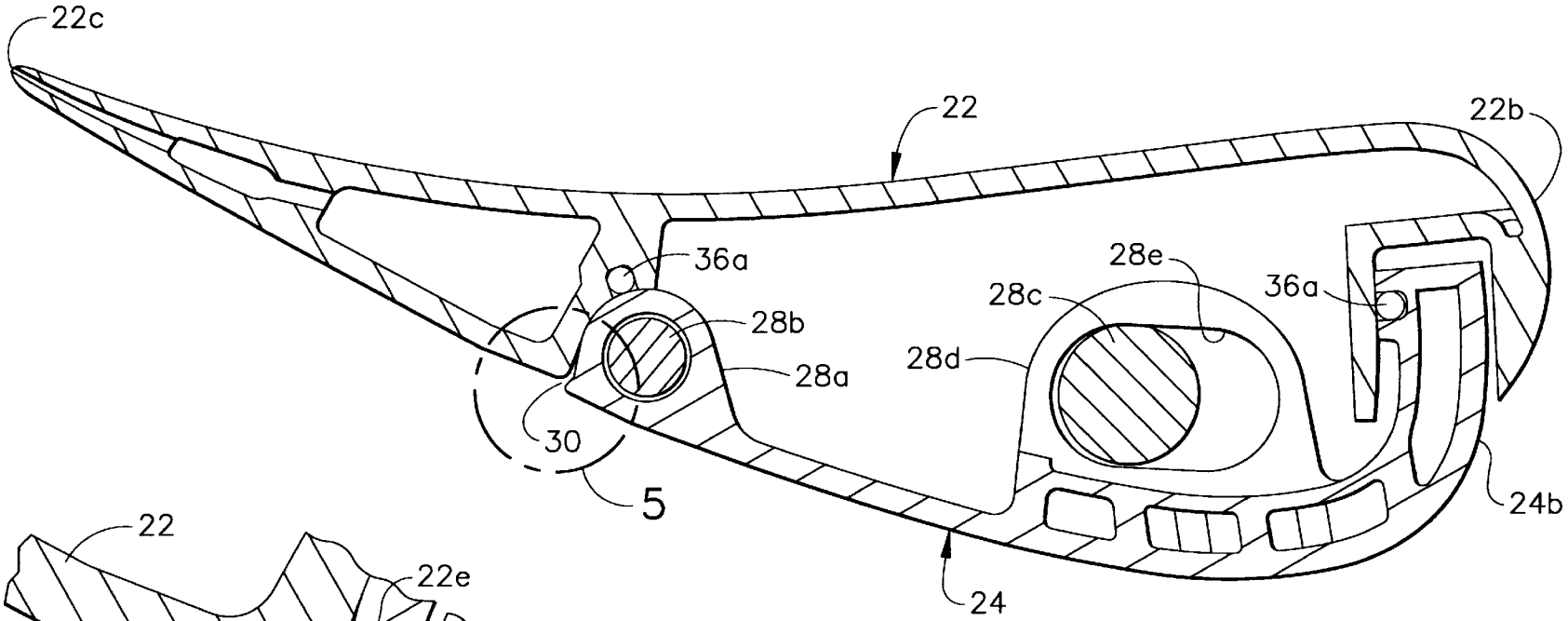
FIG. 4 is an enlarged sectional view of one of the exemplary variable area nozzle vanes illustrated in FIG. 2.

Correspondingly, the cam shaft 28*c* includes a radially offset cylindrical cam or lobe extending through the two lug slots 28*e* in a close lateral fit for pivoting the second vane segments 24 between expanded and contracted positions to correspondingly reduce and increase flow area of the throats 26 upon rotation of the cam shaft 28*c*. For example, FIG. 2 illustrates the second vane segments 24 pivoted to their maximum expanded or open position which in turn minimizes or closes flow area of the throat 26. In FIG. 4, the second vane segment 24 is pivoted to its contracted or closed position to maximize or open the flow area of the throat 26.

The preferred form of the cam shaft 28*c* is illustrated in more particularity in FIGS. 1 and 3. The intermediate portion of the cam shaft 28*c* defines a cylindrical cam lobe which engages the lugs 28*d*, with the outer and inner ends of the cam shaft 28*c* having suitable jogs terminating at bushings having a radial offset A. The bushings engage complementary apertures in the outer and inner bands for rotating about a radial axis of rotation, with the centerline axis of the cam being offset at the radius A therefrom. The outer end of the cam shaft 28*c* is suitably joined to a conventional lever 28*f*, which in turn is pivotally joined to an annular unison ring 28*g* in a manner similar to the actuation of conventional compressor stator vanes. Suitable actuators (not shown) rotate the unison ring 28*g* about the centerline axis of the engine to in-turn rotate the levers 28*f* which rotate the respective cam shafts 28*c*. The offset A of the cam shaft 28*c* as illustrated in FIG. 2 causes relative movement laterally between the opposing first and second vane segments 22,24 to effect relative expansion and contraction therebetween.

In FIG. 2, the cam shaft 28*c* is rotated through its maximum lateral displacement from the first vane segment 22 to position the second vane segment 24 at its maximum expanded position to effect the minimum throat area. In the preferred embodiment illustrated in FIG. 2, the lug oval slots 28*e* have parallel flat sidewalls defining a minor axis of minimum length therebetween, and semicircular opposite sidewalls define therebetween a major axis of maximum length.

The minor axis is preferably disposed substantially parallel to the plane of the adjacent throat 26, with the major axis being generally parallel to the chord line extending between the leading and trailing edges 22*b, c* of the first vane segment 22 at the maximum expanded position. In the maximum expanded position illustrated in FIG. 2, the cam shaft 28*c* may be rotated a full 90° clockwise, for example, for contracting the second vane segment 24.

A significant benefit of this arrangement, is the mechanical advantage provided by the cam shaft, and the very fine angular adjustment capability therewith. For example, 90° rotation of the cam shaft between the expanded and contracted positions of the second vane segments 24 may correspond with only 9° rotation of the second vane segments 24 about the hinge pins 28*b*. In the initial travel from the maximum expanded position, substantially less than 0.5° of rotation of the second vane segments 24 can be obtained with up to about 20° of rotation of the cam shaft 28*c*, with a corresponding reduction ratio greater than about 40 times. At the opposite end of travel when the second vane segments 24 are in their fully contracted position corresponding with 90° rotation of the cam shaft, a total of about 9° rotation of the second vane segment 24 is effected which corresponds with a reduction ratio of ten times.

Accordingly, extremely fine adjustment of the flow area of the throats 26 may be obtained near the maximum expanded positions of the second vane segments 24 for correspondingly accurately adjusting the variable cycle of the engine. Suitably fine adjustment is also provided when the second vane segments 24 are in their maximum contracted position as well.

For ease of assembly and disassembly, the size of the oval slot 28*e* is selected to complement the profile of the cam shaft 28*c* so that the cam shaft 28*c* may be readily inserted radially inwardly through the outer band 16, the two lugs 28*d*, and inserted into the inner band 18. The inner bushing of the cam shaft 28*c* is preferably smaller than the outer bushing for allowing this ease of assembly. For disassembly, the cam shaft 28*c* may simply be withdrawn in the reverse, radially outward direction. Correspondingly, the relatively simple hinge pin 28*b* is similarly simply inserted radially inwardly through the outer band 16, the hinge tube 28*a*, and into the inner band 18. This configuration allows assembly and disassembly of these three components for servicing or replacing any one thereof during a maintenance outage.

Since the nozzle segments 14 illustrated in FIG. 3 channel hot combustion gas 12 therethrough during operation, the vane segments may be suitably cooled using any conventional cooling technique including film and impingement cooling for example. In vane cooling, a portion of pressurized air 32 is suitably bled from the compressor (not shown) and channeled to the nozzle segments 14. The sidewalls of the first and second nozzle segments 22, 24 may be of a suitable double-wall construction for channeling the pressurized air 32 therebetween for effecting suitable cooling thereof.

As shown in FIG. 3, the top bushing of the cam shaft 28*c* includes an aperture therethrough through which a portion of the pressurized air 32 may be channeled inside the hollow two-segment vane for internal cooling thereof. The pressure of the air 32 is substantially greater than the pressure of the combustion gas 12 which differential pressure is useful for self-deploying the second vane segments 24 into their maximum expanded positions. The cam shafts 28*c* restrain deployment of the second vane segments 24 against the differential pressure force until the cam shafts 28*c* are rotated. Rotation of the cam shafts 28*c* allows the second vane segments 24 to pivot outwardly from the first vane segments 22, with the cam shafts 28*c* also providing a mechanical force for actuation if required against any inherent frictional restraining forces occurring during operation.

Since the second vane segments 24 are relatively thin-walled members, they are subject to differential thermal and pressure loads during operation. Accordingly, the two lugs 28*d* illustrated in FIG. 3 are preferably spaced apart radially at opposite hub and tip ends of the second vane segments 24 to maximize the distance therebetween, and to maximize the reaction constraint on the second vane segments 24 at their hubs and tips. Since the second vane segments 24 define portions of the suction side of the individual vanes, they are highly loaded aerodynamically during operation and are restrained from outward deflection at the hub and tip by the respective lugs 28*d* which in turn transfer loads to the cam shaft 28*c*. This arrangement enhances flow area control without over-constraining the suction sidewall which could cause excessive thermal stress.

Correspondingly, the hinge pin 28*b* illustrated in FIGS. 1 and 3 preferably has a reduced diameter center section between the maximum diameter outer and inner ends thereof. In this way, the hinge tube 28*a* illustrated in FIG. 3 is constrained at the hinge pin 28*b* solely at the outer and inner portions thereof. This again constrains outward deflection of the second vane segments 24 at their hubs and tips against the substantial pressure loads applied thereacross. The reduced center section of the hinge pin 28*b* reduces the likelihood of frictional binding with the hinge tube 28*a* due to pressure and thermal distortion during operation. In this way, each of the second vane segments 24 is joined to its complementary first vane segment 22 at four points, solely at the hubs and tips thereof corresponding with the lug and cam joints and the hinge tube and pin joints.

As shown in FIG. 2, the lugs 28*d* are preferably disposed on the second vane segments 24 adjacent to the throats 26 as space permits to effect a nodal point of minimum differential displacement due to thermal or pressure loading. Since the second vane segments 24 are effectively mounted solely at four reaction points, these segments are subject to distortion and displacement due to thermal gradients and differential pressure. Such displacement can adversely affect the accuracy of the flow area at the throats 26. By placing the lugs 28*d* and corresponding cam shaft 28*c* closely adjacent the throat 26, a node of little or no relative displacement will be effected thereat, with relative displacement instead being effected away from the throat 26. And, the lugs 28*d* are also preferably disposed close to the center-of-pressure P of the vane to reduce bending distortion. The area of the throat 26 may therefore be more accurately maintained during operation.

Figure 5:
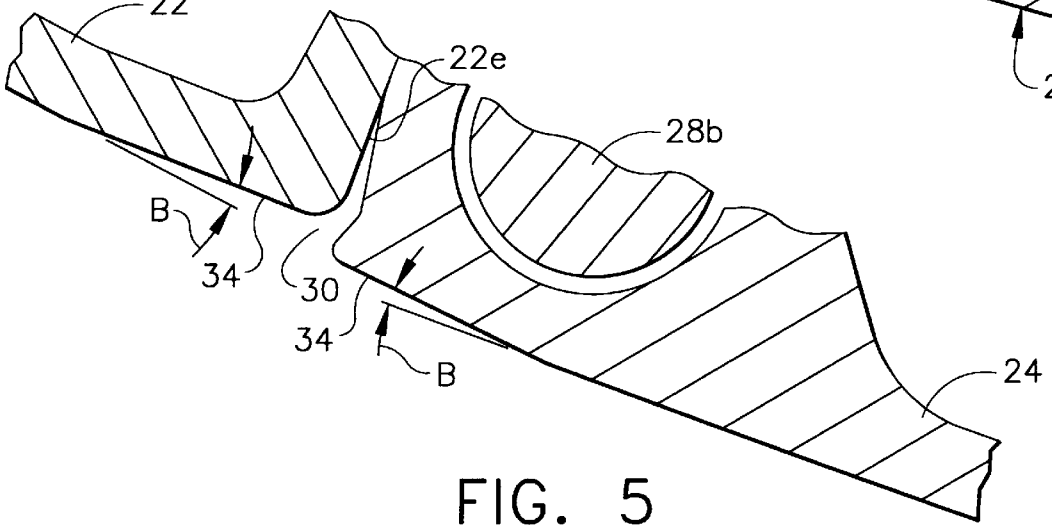
FIG. 5 is an enlarged sectional view of a hinge gap formed between stationary and movable segments of the nozzle vane illustrated in FIG. 4 within the circle labeled 5.

As shown in FIG. 2, the suction sidewall adjacent the hinge gap 30 should be relatively coextensive for maintaining an aerodynamically smooth contour for maximizing nozzle vane aerodynamic efficiency. However, when the second vane segments 24 are pivoted to their maximum contracted position as illustrated in FIG. 4, the hinge gap 30 necessarily increases at the suction sidewall, which experiences a small bend or kink corresponding with the maximum angular travel of the second vane segment 24, which is about 9° in the exemplary embodiment. In order to improve aerodynamic performance when the second vane segments 24 are disposed in the maximum contracted position as illustrated in FIGS. 4 and 5, both the first and second vane segments 22, 24 at the hinge gap 30 include suitable chamfers 34 to reduce step discontinuity at the hinge gap 30 for reducing aerodynamic flow disruption with the second vane segments 24 in the contracted position. The chamfers 34 have a small acute angle B relative to the nominal surface of the suction sidewall, which angle B is about 4.5°, or half the maximum angular travel, in the exemplary embodiment.

As indicated above, suitable means are provided for channeling the pressurized air 32 into the individual vanes defined by the complementary first and second vane segments 22, 24 for cooling thereof. Accordingly, suitable means 36 are also required for sealing the second vane segments 24 to the outer and inner bands 16, 18 and to the first vane segments 22 at the hinge gaps 30 to confine the pressurized air inside the vanes upon pivoting travel of the second vane segments 24. As shown in FIG. 4, suitable wire seals 36*a* are preferably disposed in complementary semicircular seats to seal the hinge gap 30 radially along the hinge tube 28*a* at the aft end of the second vane segments 24, and to seal a similar gap at the forward end thereof.

The hinge tube 28*a* preferably has a cylindrical outer surface which extends the entire radial extent of the second wall segment 24 so that the hinge gap 30 is relatively constant in thickness and may be effectively sealed by the wire seal 36*a*. The forward end 24*b* of the second vane segment 24 internally overlaps a complementary portion of the first vane segment 22 at the leading edge 22*b* for accommodating the required expansion and contraction travel relative thereto. The corresponding wire seal 36*a* may therefore be disposed at any suitable location for sealing the overlapping joint between the first and second vane segments 22, 24 at the leading edge.

And, as shown schematically in FIG. 1, suitable end seals 36*b* in the exemplary form of spline seals may be mounted in corresponding recesses in the hub and tip of the second vane segments 24 for engaging complementary surfaces of the outer and inner bands 16, 18 to effect sealing therebetween.

The improved variable area nozzle 10 disclosed above may be used in a high pressure turbine nozzle with preferably two vanes per segment 14, but could also be used in low pressure turbine nozzles having two or more vanes per segment. The integral first vane segments 22 effect a rigid supporting structure with the outer and inner bands 16, 18 capable of withstanding the severe temperature and pressure environment of the turbine nozzles. This box structure also provides a suitable support for pivotally mounted second vane segments 24 thereto in various configurations.

In the preferred embodiment, each of the second vane segments 24 is hinge mounted at its aft end 24*c* using the integral hinge tube 28*a* and cooperating hinge pin 28*d* which carries reaction loads directly to the outer and inner bands 16, 18. Pivoting of the second vane segments 24 is controlled by the specifically configured offset cam shaft 28*c* cooperating with the radially spaced apart lugs 28*d*. The lugs 28*d* carry reaction loads through the cam shaft 28*c* directly to the outer and inner bands 16, 18 in a manner similar to the hinge pin 28*b*. In this way, both the hinge pin 28*b* and cam shaft 28*c* carry reaction loads primarily in shear instead of bending which more effectively utilizes the strength capability thereof allowing relatively small size for accommodating the relatively high loads involved.

The preferred configuration of the cam shaft and the lugs adjacent the vane throats 26 minimizes the effects of thermal and pressure distortions on the throat area. The mechanical reduction ratio between rotation of the cam shaft and rotation of the second vane segments 24 provides both extremely small adjustment capability of the area of the vane throat, with correspondingly high mechanical advantage which further reduces the size of the actuating linkages and required actuating force. The preferred arrangement of the cam shaft and lugs also prevents the possibility of overexpansion of the second vane segments 24 at their forward ends 24*b* which would undesirably unlap the vane segments at the leading edge.

Since the inherent pressure of the cooling air 32 inside the vane segments may be effectively utilized for expanding the second vane segments 24 to their open positions, different forms of the pivoting means may be used. For example, the lugs 28*d* may be eliminated, with the cam shaft being in the simple form of a cylindrical spindle to which is attached a suitable high temperature flexible ligament joined at its opposite end to the inside of the second vane segments 24. The spindle may be rotated for reeling in and out the ligament for contracting and expanding the second vane segments as desired. The ligament would remain in tension during operation due to the differential pressure force acting across the second wall segments. A primary advantage of this configuration is that there are no rubbing surfaces, but a disadvantage is that it is not double-acting since the flexible ligament is not effective for expanding the second wall segments without the use of the differential pressure thereacross. Other configurations of the pivoting means may also be used.

While there have been described herein what are considered to be preferred and exemplary embodiments of the present invention, other modifications of the invention shall be apparent to those skilled in the art from the teachings herein, and it is, therefore, desired to be secured in the appended claims all such modifications as fall within the true spirit and scope of the invention.

Accordingly, what is desired to be secured by Letters Patent of the United States is the invention as defined and differentiated in the following claims:

We claim:

1. A variable area turbine nozzle segment comprising:

outer and inner spaced apart bands;

a plurality of first vane segments extending between said bands and fixedly joined thereto;

a plurality of second vane segments adjoining respective ones of said first vane segments to define therewith corresponding vanes, said vanes being spaced apart from each other to define a throat of minimum flow area for channeling therethrough combustion gas; and means for pivoting said second vane segments to vary said throat area, and including two hinge joints and two actuation joints joining together respective pairs of said first and second vane segments solely at hubs and tips thereof.

2. A nozzle segment according to claim 1 wherein said actuation joints are disposed adjacent said throats.

3. A nozzle segment according to claim 1 wherein said actuation joints are disposed adjacent a center of pressure of each of said vanes.

4. A nozzle segment according to claim 1 wherein said pivoting means further comprise a respective cam shaft extending through said two actuation joints of each of said vanes, said cam shaft being rotatable to pivot said second vane segment about said hinge joints with greater reduction ratio at minimum area of said variable throat than at a maximum area of said variable throat.

5. A variable area turbine nozzle segment comprising:

outer and inner spaced apart bands;

a plurality of first vane segments extending between said bands and fixedly joined thereto;

a plurality of second vane segments adjoining respective ones of said first vane segments to define therewith corresponding vanes, said vanes being spaced apart from each other to define a throat of minimum flow area for channeling therethrough combustion gas; and means for pivoting said second vane segments to vary said throat area, comprising:

a hinge tube fixedly joined to respective ones of said second vane segments at one end thereof to define with a complementary seat of said first vane segments a hinge gap;

a hinge pin extending through said bands and respective ones of said hinge tubes to mount said second vane segments to said first vane segments for pivoting movement; and an actuation shaft extending through said bands and operatively joined to respective ones of said second vane segments to pivotally adjust said second vane segments to vary said throat area.

6. A nozzle segment according to claim 5 wherein said pivoting means further comprise:

a plurality of spaced apart lugs fixedly joined in pairs to each of said second vane segments; and said actuation shaft is a cam shaft extending through said bands in respective pairs of said lugs for pivotally engaging said lugs to pivotally adjust said second vane segments to vary said throat area.

7. A nozzle segment according to claim 6 wherein:

each of said lugs includes an oval slot; and said cam shaft includes an offset cam extending through said lug slots for pivoting said second vane segments between expanded and contracted positions to correspondingly reduce and increase said throat area upon rotation of said cam shaft.

8. A nozzle segment according to claim 7 wherein:

said second vane segments have opposite hub and tip ends;

said lugs are disposed at opposite ends of said second vane segments at said hubs and tips; and said hinge pin engages said hinge tube solely at said hubs and tips.

9. A nozzle segment according to claim 8 wherein said lugs are disposed on said second vane segments adjacent said throats to effect a nodal point of minimum differential displacement.

10. A nozzle segment according to claim 9 wherein:

said second vane segments have a maximum expanded position to effect a minimum throat area; and said lug oval slots have a minor axis disposed substantially parallel to said adjacent throats at said maximum expanded position, with said cam being pivoted to maximum extension.

11. A nozzle segment according to claim 7 wherein:

each of said first vane segments is aerodynamically configured to define a pressure sidewall extending between leading and trailing edges; and each of said second vane segments is aerodynamically configured to define a portion of a suction sidewall extending between forward and aft edges, with said hinge gap being disposed part-chord therebetween.

12. A nozzle segment according to claim 11 wherein said first and second vane segments at said hinge gap include acute angle chamfers for reducing aerodynamic flow disruption with said second vane segments in said contracted position.

13. A nozzle segment according to claim 6 further comprising:

means for channeling pressurized air inside said vanes for cooling thereof; and means for sealing said second vane segments to said bands and to said first vane segments at said hinge gaps to confine said pressurized air inside said vanes over pivoting travel of said second vane segments.

* * * * *